US006303888B1

(12) United States Patent
Okamoto et al.

(10) Patent No.: US 6,303,888 B1
(45) Date of Patent: Oct. 16, 2001

(54) SWITCH, CLICK PLATE AND SWITCH AND METHOD OF ATTACHING CLICK PLATE FOR SWITCH

(75) Inventors: Satoshi Okamoto; Toshiya Inubushi; Koji Saito, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/606,224

(22) Filed: Jun. 29, 2000

Related U.S. Application Data

(63) Continuation of application No. PCT/JP98/05792, filed on Dec. 22, 1998.

(51) Int. Cl.[7] ..... H01H 13/70
(52) U.S. Cl. ..... 200/517; 200/406; 200/516
(58) Field of Search ..... 200/511–517, 5 A, 200/406; 29/622

(56) References Cited

U.S. PATENT DOCUMENTS 5,286,937 * 2/1994 Santo et al. ..... 200/516
5,399,823 * 3/1995 McCusker ..... 200/521
5,510,584 * 4/1996 Norris ..... 200/5 A
5,924,555 * 7/1999 Sadamori et al. ..... 200/512
6,073,341 * 6/2000 Odorfer ..... 29/623

FOREIGN PATENT DOCUMENTS 59136127 9/1984 (JP) ..... H01H/13/70
06168641 6/1994 (JP) ..... H01H/9/02

* cited by examiner

*Primary Examiner*—Michael Friedhofer
(74) *Attorney, Agent, or Firm*—Rothwell, Figg, Ernst & Manbeck

(57) ABSTRACT

A click plate (9) constituting a switch used for an operation key etc. of a portable telephone is attached on a substrate (1 by soldering it on a contact pattern (6) formed on the substrate. The click plate (9) includes a convex portion (11) which center portion is expanded and made hollow. The convex portion is pushed and deformed to contact with a contact pattern (7) on the substrate thereby to generate a contact signal. The peripheral portion (10) of the click plate (9) is provided with attachment portions (17) protruded outward. The attachment portions (17) are soldered on the contact pattern (6). In this manner, the click plate can be attached on an arbitrary position in a manner that the click plate (9) is attached on the substrate (1) by the soldering.

3 Claims, 5 Drawing Sheets

SWITCH, CLICK PLATE AND SWITCH AND METHOD OF ATTACHING CLICK PLATE FOR SWITCH

This application is a continuation of PCT international application No. PCT/JP98/05792 which has an international filing date of Dec. 22, 1998, which designated the United States, the entire contents of which are hereby incorporated by reference.

BACKGROUND OF THE INVENTION

1. Field of the Invention

The present invention relates to a switch used for an operation panel of en electronic device such as a portable telephone etc., for example, a click plate used for the switch and a method of attaching the click plate to a substrate.

2. Description of the Related Art

An electronic device having an operation switch, for example, a portable telephone has been spread widely and the production thereof has been increased. Thus, the company for manufacturing portable telephones is required to cope with the variety of the needs of the market such as the addition of new functions increased in accordance with the spread thereof and to reduce the manufacturing cost thereof required in accordance with the increase of the production thereof. Accordingly, it becomes difficult for the portable telephone manufacturing company to manufacture all parts of the portable telephones and to assemble the parts, so that the portable telephone manufacturing company purchases various kinds of the parts from the parts manufacturing company and assembles the parts. On the other hand, cost of the parts can not be reduced when the parts manufacturing company provides the portable telephone manufacturing company with parts of different design specification at every type of the portable telephone. Thus, normally, the design specification is standardized so as to cope with various type of the portable telephones and the parts of the same design specification are provided.

Conventionally, the configuration shown in FIGS. 1 and 2 is employed as a switch such as ten keys, function keys etc. employed for an operation panel of a portable telephone.

FIG. 1 is a perspective view showing a state where a conventional switch is assembled on a substrate which is housed within the casing of a portable telephone. FIG. 2A is a sectional view showing a state where the switch is not operated and FIG. 2B is a sectional view showing a state where the switch is operated.

In the figures, a reference numeral 1 depicts a substrate which is housed within the casing of the portable telephone and on which the wiring is printed. The main circuit section of the portable telephone such as a control section, a radio section etc. (not shown) is provided and various kinds of electronic parts are mounted on the rear surface of the substrate. A reference numeral 2 depicts electronic parts such as LEDs, resistors etc. mounted on the substrate 1, 3 a liquid crystal display element for displaying a telephone number and a menu screen, 4 a speaker, 5 a microphone, 6 and 7 first and second contact patterns formed on the substrate 1 with a predetermined distance therebetween concentrically, and 8 an outer chassis which is formed by molding resin and constitutes a part of the casing of the portable telephone. A reference numeral 9 depicts a click plate which is made from electric conductive material and includes a peripheral portion 10 and a convex portion 11 which center portion is expanded and made hollow. The peripheral portion 10 is coupled to the contact pattern 6 and the convex portion 11 is arranged in a manner that the inner surface of its hollow portion can be coupled to the contact pattern 7 when it is pushed and deformed. A reference numeral 12 depicts an adhesive sheet adhered to the click plates in a state that the click plates 9 are respectively disposed at predetermined positions in advance. The arrangement of the click plates 9 is made correspond to the arrangement of the contact patterns 6 in a manner that the peripheral portions 10 of the click plates 9 are coupled to the corresponding contact patterns 6 respectively when the adhesive sheet is pasted on the substrate 1. A reference numeral 13 depicts a hole provided at the adhesive sheet 12 so as to correspond to the position of the associated electronic part 2 when the adhesive sheet 12 is pasted on the substrate 1. A reference numeral 14 depicts a key switch which is formed by silicon rubber and includes a key top portion 15 and an actuator portion 16.

The manufacturing procedure of the conventional switch thus configured will be explained with reference to FIG. 1.

That is, the adhesive sheet 12 to which the click plates 9 are pasted is fabricated by the parts manufacturing company. The click plates 9 are pasted on the adhesive surface of the adhesive sheet 12 in the arrangement determined by the standard specification. The adhesive surface of the adhesive sheet 12 is pasted on the substrate 1 so that the peripheral portions 10 of the click plates 9 are disposed on the corresponding first contact patterns 6 respectively. In this case, the convex portions 11 of the click plates 9 are positioned at the portions corresponding to the associated second contact patterns 7, respectively. Further, the electronic parts 2 on the substrate 1 fit into the corresponding holes 13 of the adhesive sheet 12 so as to be positioned at portions not covered by the adhesive sheet 12.

The electronic parts 2 are attached to the substrate 1 normally in a manner that the electronic parts are mounted on the substrate by using a mounting machine and then soldered by the reflow soldering process. The electronic parts are attached on the substrate in the following procedures. First, a metal plate calling a metal mask is superimposed on the substrate 1 to mask the substrate, and the cream solder is pasted. The metal mask is provided with holes at the portions corresponding to pad portions on the substrate 1 to which the electronic parts are attached. Thus, when the substrate 1 is masked and the cream solder is pasted, the cream solder is pasted only on the pad portions. Then, the terminal portions of the electronic parts 6 are positioned on the pad portions on which the cream solder is pasted and then mounted on the pad portions. The mounting procedure of the electronic parts 2 on the substrate 1 is performed in a manner that, for example, a computer reads the soldering portions of the electronic parts 2 and the electronic parts are mounted on the substrate by using a mounting machine. Then, the substrate 1 on which the electronic parts 6 are mounted is subjected to the reflow process to apply predetermined heat on the substrate 1 to melt the cream solder, whereby the terminal portions of the electronic parts 2 are soldered on the corresponding pads, respectively.

Further, at the time of assembling a portable telephone, as shown in FIG. 2A, the key switch 14 is disposed in a manner that the tip portion of the actuator 16 is positioned almost at the center portion of the convex portion 11 of the corresponding click plate 9 and the key switch 14 is held such that it is sandwiched between the substrate 1 and the outer chassis 8.

The liquid crystal display element 3, the speaker 4 and the microphone 5 are coupled to and mounted on the substrate 1 by solder and connectors. In recent years, due to the improvement of the part mounting technique and the part manufacturing technique, these parts are made cope with the mounting machine and the automatic mounting technique employing the reflow process so long as the parts are not such ones as the liquid crystal display element 3 which is largely influenced by the breakage caused by the heat at the time of the reflow process.

Then, the operation of the switch will be explained with reference to FIGS. 2A and 2B.

When a user of the portable telephone pushes the key top portion 15 as the key operation, the actuator 16 pushes and deforms almost the center portion of the convex portion 11 of the corresponding click plate 2 in an interlocked manner with the key top portion 15 as shown in FIG. 2B, so that the inner surface of the hollow portion of the convex portion contacts with the corresponding second contact pattern 7. In this case, the first contact pattern 6 is made conductive with the corresponding second contact pattern 7 through the corresponding click plate 9. Thus, a desired control signal is transmitted to the electronic parts 2 on the substrate 1 and so characters, signs etc. corresponding to the key operation are displayed on the liquid crystal display element 3.

Since the conventional switch is configured in the aforesaid manner, there are the following problems.

That is, the cost can not be reduced when the adhesive sheet 12 having different arrangement of the click plates 9 at every type of a portable telephone having different key arrangement and substrate plate is provided. Thus, it is required to reduce the cost by standardizing the design specification so as to cope with various types of the portable telephones and providing the adhesive sheet 12 having the common arrangement of the click plates.

However, in fact, in order to cope with the variety of the needs of the market such as the addition of new functions increased in accordance with the spread of the portable telephones, the portable telephone manufacturing company must purchase from the parts manufacturing company the adhesive sheets 12 of the respective specifications on which the click plates 9 are arranged in accordance with the respective types of the portable telephones, so that there arises a problem that the cost of the portable telephone becomes expensive.

Further, there arises a problem that the thickness of the switch becomes thicker by the thickness of the adhesive sheet 12. As a result, the thickness of the portable telephone is influenced by the thickness of the adhesive sheet. That is, in recent years, the miniaturization of the portable telephone is progressively advanced by miniaturizing and lightweighting the respective electronic parts 2, the outer chassis 8 etc. in accordance with the needs of the market. Since, usually, the entire thickness of the portable telephone is almost occupied by the thickness of a battery disposed at the rear surface side of the portable telephone, it is most effective to make the thickness of the battery thinner in order to make the portable telephone thinner. However, the thickness of the battery is depending on the technique of the battery manufacturing company. Further, due to the increase of the call waiting time of the telephone in accordance with the needs of the market, the electric capacity of the battery has been increased, and so the miniaturization of the battery can not so be expected to such a degree of the actual technical development. Thus, the portable telephone manufacturing company has developed so as to make the thickness of the various kinds of parts other than the battery such as the substrate 1, the electronic parts 2, the outer chassis 8 etc. to their limited values.

SUMMARY OF THE INVENTION

The present invention has been made to eliminate the above drawbacks with the prior art, and an object of the invention is to provide a switch which is arranged with the degree of freedom so as to cope with respective switch arrangements for the respective types of switches.

Another object of the invention is to provide a click plate for a switch which can be disposed at an arbitrary position on a substrate by soldering.

Still another object of the invention is to provide a method of attaching a click plate for a switch which can be soldered by the same step as the soldering step of the electronic part and facilitate the assembling procedure.

To achieve the above objects, according to the invention, there is provided a switch, comprising:

- a click plate having a convex portion which center portion is expanded and made hollow and provided with attachment portions for soldering at peripheral portions thereof;
- a first contact pattern formed on a substrate, for soldering and fixing the attachment portions thereto; and
- a second contact pattern formed on the substrate in correspondence with a position within the hollow portion of the click plate fixed to the first contact pattern;
- wherein when the convex portion of the click plate is pressed and deformed, the inner surface of the hollow portion of the convex portion contacts with the second contact pattern, so that the first contact pattern is made conductive with the second contact pattern through the click plate.

Also, in the invention, a pair of the attachment portions are provided at the peripheral portions of the click plate in an opposite manner.

Further, according to the invention, there is provided a click plate for a switch which is disposed on a substrate and delivers a contact signal by making conductive between a first contact pattern and a second contact pattern, said click plate comprising:

- a convex portion which center portion is expanded and made hollow and which is capable of being deformed when being pushed; and
- attachment portions formed so as to protrude outward from peripheral portions of the convex portion, for soldering and fixing the click plate on the substrate.

Furthermore, according to the invention, there is provided a method of attaching a click plate for a switch, comprising:

- a first step of pasting cream solder on a first contact pattern which is formed by printing wiring on a substrate and on a pad on which an electronic part to be placed on the substrate is attached;
- a second step of positioning and placing a terminal portion of the electronic part on the pad on the substrate on which the cream solder is pasted, positioning attachment portions of the click plate for the switch on the first contact pattern on which the cream solder is pasted, and placing an inner surface of a hollow portion of the click plate for the switch in correspondence with a second contact pattern on the substrate; and
- a third step of, after the second step, applying predetermined heat on the substrate to melt the cream solder thereby to solder the electronic part and the click plate for the switch on the substrate.

DETAILED DESCRIPTION OF THE PREFERRED EMBODIMENTS

The best mode for carrying out the invention will be explained in accordance with the accompanying drawings in order to explain the invention more in detail.

(First Embodiment)

Hereinafter, the embodiment of the invention will be described with reference to FIGS. 3 to 5.

Figure 3:
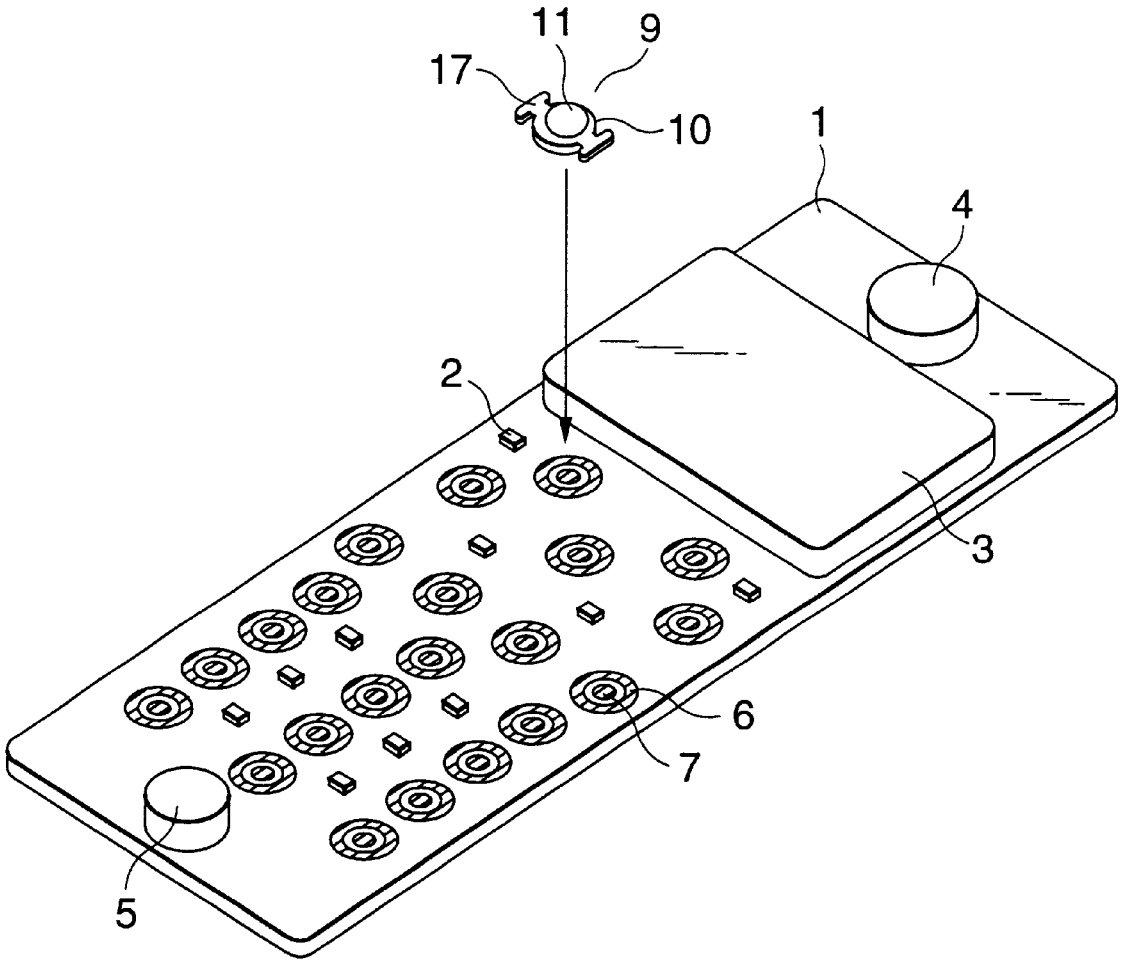
FIG. 3 is a perspective view showing the arrangement of a switch according to an embodiment of the invention.
Figure 4A:
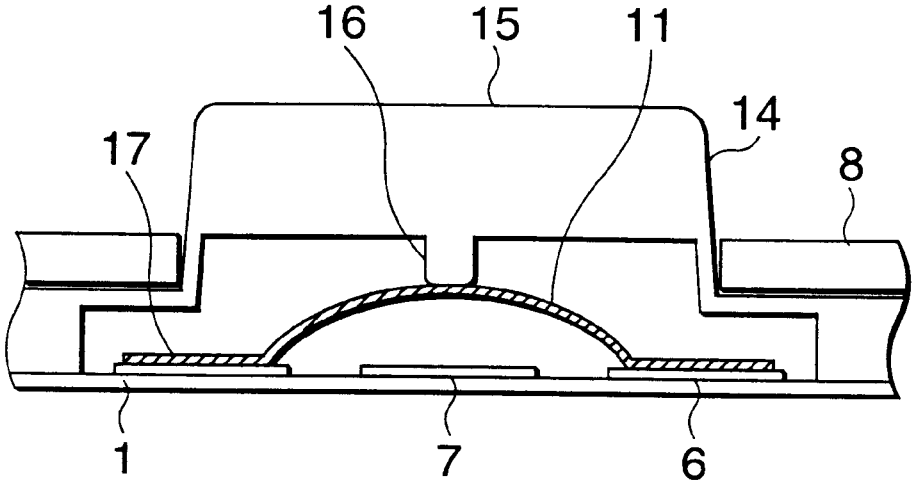
FIGS. 4A and 4B are sectional views showing the operation of the switch according to the embodiment of the invention.
Figure 4B:
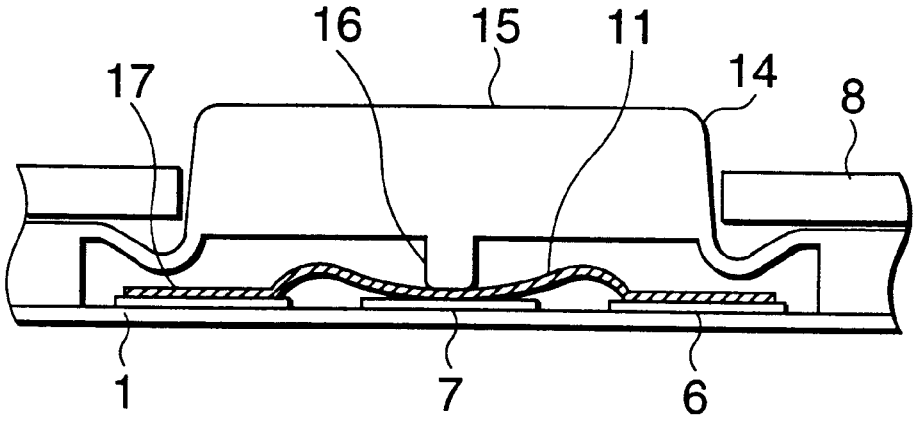

FIG. 3 is a perspective view showing the arrangement of a switch according to the embodiment of the invention. FIGS. 4A and 4B are sectional views showing the operation of the switch according to the embodiment of the invention. FIG. 5 is a plan view and a sectional view of a click plate disposed on a substrate in the embodiment of the invention.

Figure 1:
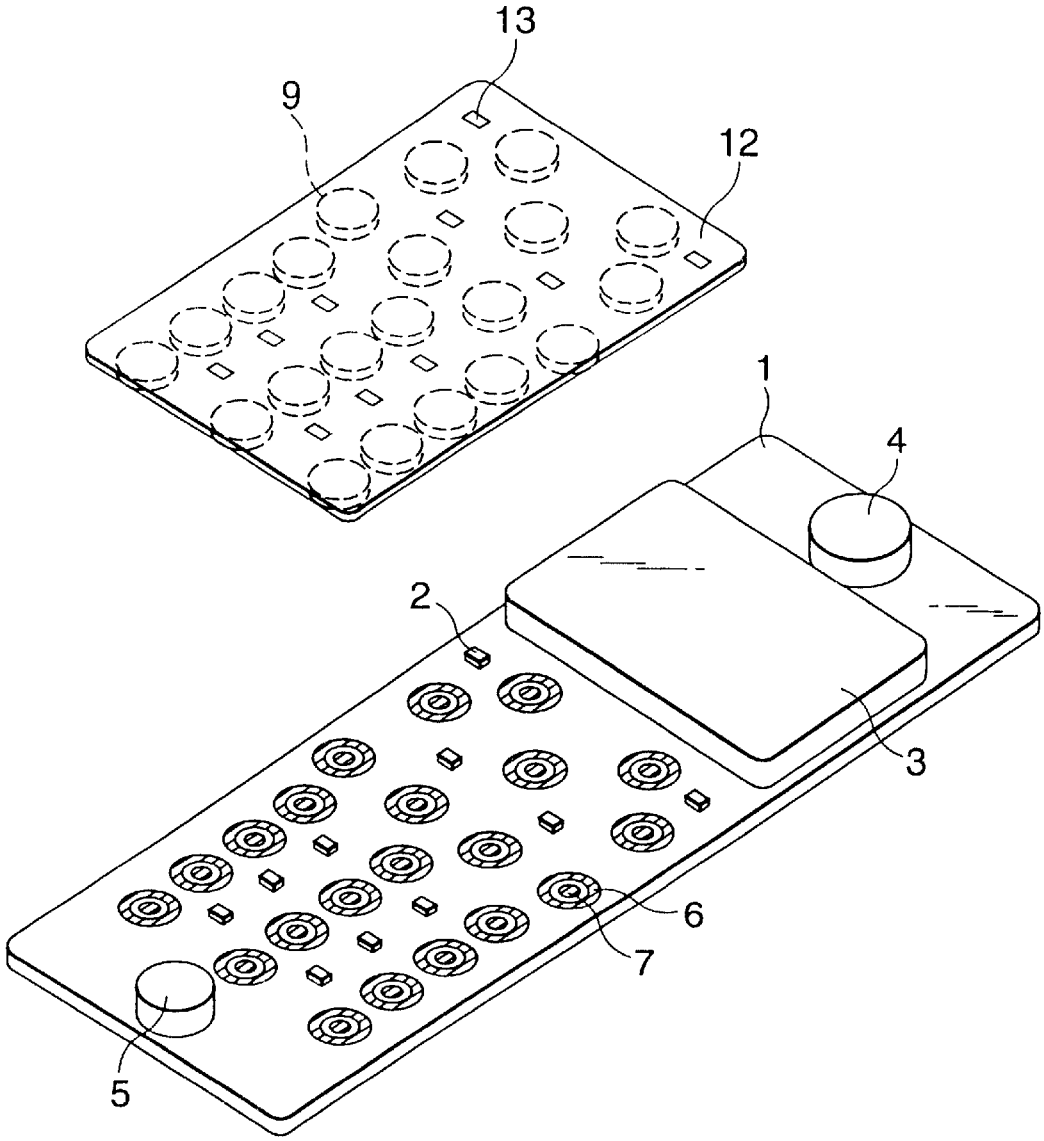
FIG.1 CONVENTIONAL ART
FIG. 1 is a perspective view showing the arrangement of a conventional switch.
Figure 2A:
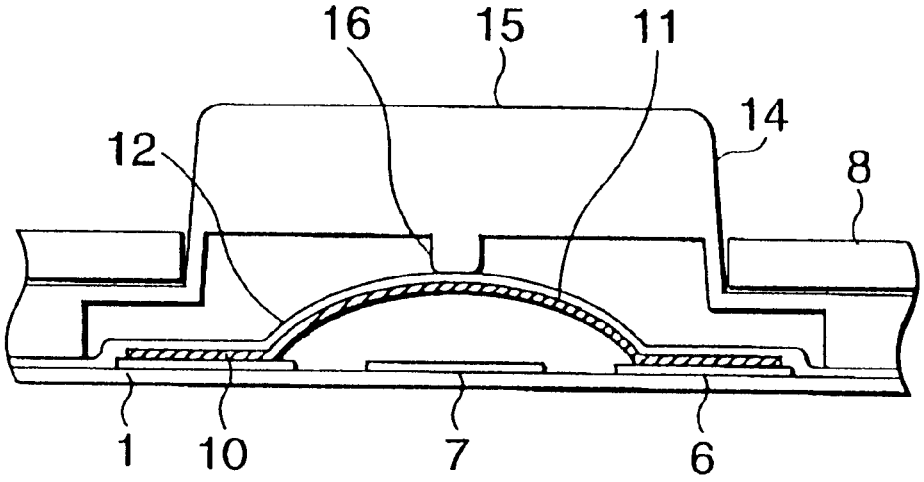
FIG.2A CONVENTIONAL ART
FIGS. 2A and 2B are sectional views showing the operation of the conventional switch.
Figure 2B:
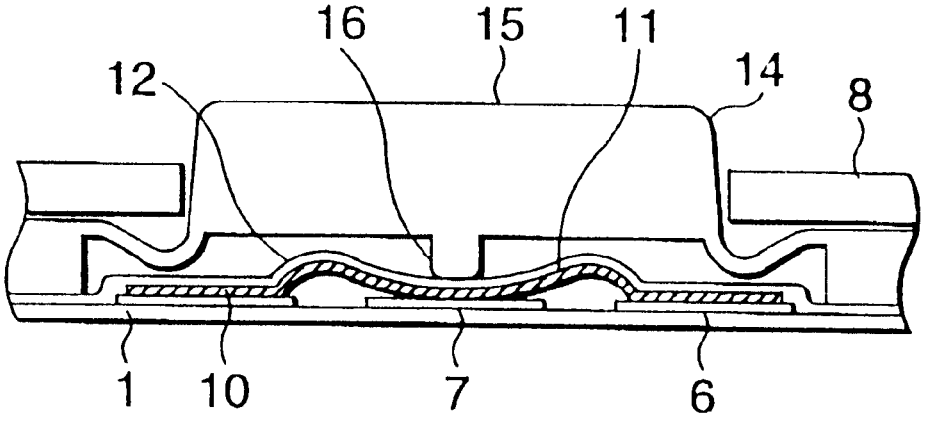
FIG.2B CONVENTIONAL ART
Figure 5:
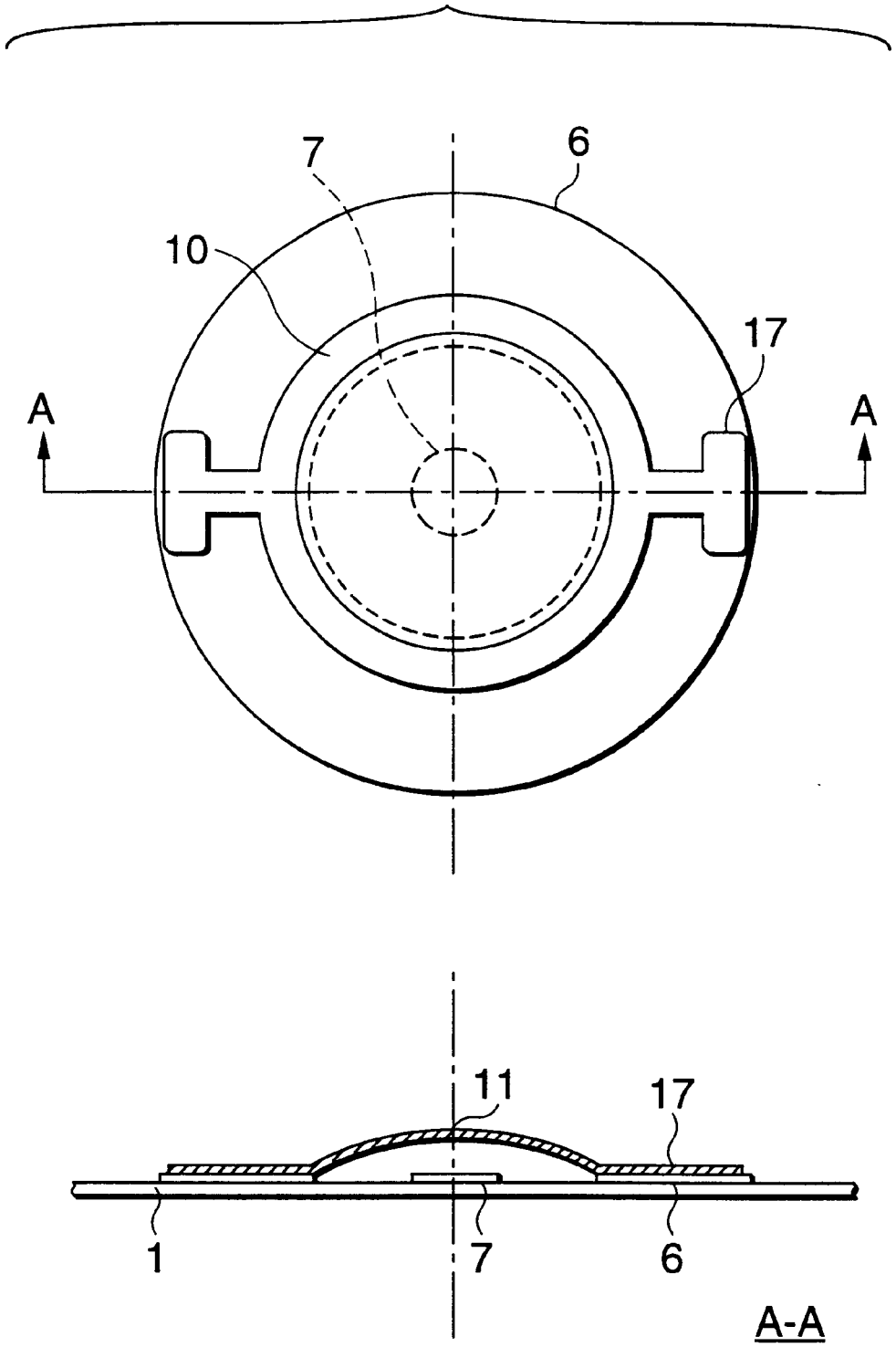
FIG. 5 is a plan view and a sectional view of a click plate disposed on a substrate in the embodiment of the invention.

In FIGS. 3 to 5, the same or like parts corresponding to those of the conventional apparatus shown in FIGS. 1 and 2 are marked with the same references.

In the figures, a reference numeral 9 depicts a click plate which is formed in a manner that, as shown in FIG. 5, a phosphor bronze plate of plate shape is formed by the press processing, then the plate is subjected to the punching pressing process and the center portion thereof is expanded and made hollow to form a convex portion 11. Further, the opposite two portions of the peripheral portion 10 of the plate is protruded outward to form a pair of attachment portions 17 which are soldered and fixed to the corresponding contact pattern 6 on a substrate 1. The convex portion 11 has such elasticity that it can be deformed and turned over when pushed and then restored when removing the pressing force applied thereto.

Then, the manufacturing procedure of the switch according to the embodiment of the invention will be explained with reference to FIG. 3.

The click plates 9 are mounted on the substrate 1 together with electronic parts 2 in a manner that they are mounted thereon by a mounting machine and subjected to the reflow processing. The click plates and the electronic parts are attached on the substrate in the following processes. First, a metal mask is superimposed on the substrate 1 to mask the substrate, and the cream solder is pasted, whereby the cream solder is pasted only on the first contact portions 6 on which the attachment portions 17 of the click plates 9 are soldered and also only on the pad portions on which the terminals of the electronic parts 2 are soldered. Then, the attachment portions 17 of the click plates 9 are positioned on the first contact portions 6 on which the cream solder is pasted and then mounted on the first contact portions, and further the terminal portions of the electronic parts 2 are positioned on the pad portions on which the cream solder is pasted and then mounted on the pad portions. The mounting procedure of the click plates 9 and the electronic parts 2 on the substrate 1 is performed in a manner that a computer reads the soldering portions and then the click plates and the electronic parts are mounted on the substrate by using the mounting machine. In this case, the click plates 9 are mounted in a manner that the inner surfaces of the convex portions 11 are made correspond to the associated second contact patterns 7, respectively. Then, the substrate 1 on which the click plates 9 and the electronic parts 2 are mounted is subjected to the reflow procedure to apply predetermined heat on the substrate 1 to melt the cream solder, whereby the click plates 9 are soldered on the first contact patterns 6 and the electronic parts 2 are soldered on the corresponding pads, respectively.

Like the prior art, at the time of assembling a portable telephone, a key switch 14 is disposed in a manner that the tip portion of the actuator 16 is positioned almost at the center portion of the convex portion 11 of the corresponding click plate 9 and the key switch 14 is held such that it is sandwiched between the substrate 1 and an outer chassis 8.

Then, the operation of the switch according to the embodiment of the invention will be explained with reference to FIGS. 4A and 4B.

FIGS. 4A and 4B are sectional views showing the operation of the switch of the portable telephone. When a user of the portable telephone pushes a key top portion 15 as the key operation, the actuator 16 pushes and deforms almost the center portion of the convex portion 11 of the corresponding click plate 9 in an interlocked manner with the key top portion 15 as shown in FIG. 4B, so that the inner surface of the hollow portion of the convex portion contacts with the corresponding second contact pattern 7. In this case, the first contact pattern 6 is made conductive with the corresponding second contact pattern 7 through the corresponding click plate 9. Thus, a desired control signal is transmitted to the electronic parts 2 on the substrate 1 and so characters, signs etc. corresponding to the key operation are displayed on a liquid crystal display element 3.

Although in the aforesaid embodiment, the click plate 9 is formed in a manner that a phosphor bronze plate of plate shape is formed by the press processing and then the plate is subjected to the punching pressing process, other metal material used as elastic material for a spring etc. may be employed therefor.

Further, although in the aforesaid embodiment, the pair of attachment portions 17 are formed in an opposite manner at the peripheral portion 10 of the click plate 9, three or more attachment portions 17 may be provided so as to more firmly fix the click plate to the substrate 1. Furthermore, the configuration of the attachment portion 17 may not be limited to that shown in FIG. 5.

What is claimed is:

1. A switch, comprising:

a click plate having a convex portion with an inner surface which center portion is expanded and made hollow;

a flat peripheral portion surrounding said convex portion;

a pair of attachment portions formed so as to protrude outward from said peripheral portion in an opposite manner;

a first contact pattern formed on a substrate, for soldering and fixing said attachment portions thereto; and a second contact pattern formed on said substrate in correspondence with a position within said hollow portion of said click plate fixed to said first contact pattern, wherein, when said convex portion of said click plate is pressed and deformed, the inner surface of the hollow portion of said convex portion contacts with said second contact pattern, so that said first contact pattern is made conductive with said second contact pattern through said click plate.

2. A click plate for a switch which is disposed on a substrate and delivers a contact signal by making contact between a first contact pattern and a second contact pattern, said click plate comprising:

a convex portion which center portion is expanded and made hollow and which is capable of being deformed when being pushed;

a flat peripheral portion surrounding said convex portion;

and a pair of attachment portions formed so as to protrude outward from said peripheral portion in an opposite manner, for soldering and fixing said click plate on said substrate.

3. A method of attaching a click plate for a switch, comprising the steps of:

pasting cream solder on a first contact pattern which is formed by printing wiring on a substrate and on a pad on which an electronic part to be placed on said substrate is attached;

reading said first contact pattern and said pad with a computer;

positioning and placing a terminal portion of said electronic part on said pad on said substrate on which said cream solder is pasted with a mounting machine, in accordance with said reading;

positioning attachment portions of said click plate for said switch on said first contact pattern on which said cream solder is pasted with said mounting machine, in accordance with said reading;

placing an inner surface of a hollow portion of said click plate for said switch in correspondence with a second contact pattern on said substrate with said mounting machine; and after said positioning step, applying predetermined heat on said substrate to melt said cream solder thereby to solder said electronic part and said click plate for said switch on said substrate.

* * * * *